US006464621B1

(12) United States Patent
Chen

(10) Patent No.: US 6,464,621 B1
(45) **Date of Patent: *Oct. 15, 2002**

(54) PUNCHING AID

(76) Inventor: Sherry Chen, 96, Chong Der 5th Road, Taichung (TW), 406

( * ) Notice: Subject to any disclaimer, the term of this patent is extended or adjusted under 35 U.S.C. 154(b) by 0 days.

This patent is subject to a terminal disclaimer.

(21) Appl. No.: 09/663,446

(22) Filed: Sep. 15, 2000

(51) Int. Cl.[7] ..... A63B 21/00
(52) U.S. Cl. ..... 482/83; 482/90; 482/87
(58) Field of Search ..... 473/441–445; 482/83–90

(56) References Cited

U.S. PATENT DOCUMENTS

| | | | | |
|---|---|---|---|---|
| 2,085,161 A | | 6/1937 | Kraus | |
| 2,913,245 A | | 11/1959 | Landis | |
| 4,486,016 A | | 12/1984 | Rubin | 272/76 |
| 4,662,630 A | | 5/1987 | Dignard et al. | 272/76 |
| 5,046,724 A | * | 9/1991 | Sotomayer | 482/83 |
| 5,330,403 A | | 7/1994 | Kuo | 482/83 |
| 5,415,552 A | | 5/1995 | Harmon et al. | 434/251 |
| 5,624,358 A | | 4/1997 | Hestilow | 482/90 |
| 5,921,895 A | | 7/1999 | Lynch et al. | 482/83 |

* cited by examiner

*Primary Examiner*—Jerome W. Donnelly
(74) *Attorney, Agent, or Firm*—Charles E. Baxley

(57) ABSTRACT

A punching aid includes a column disposed above a base, a pad attached on the column, and a flexible rubber pillar secured between the base and the column to provide a flexibility to the column relative to the base. The flexible rubber pillar includes two ends each having a coupler for detachably securing to the base and the column. The couplers each includes a protrusion and a disc engaged into the flexible rubber pillar when molding the rubber pillar. The flexible rubber pillar includes an upper and a lower peripheral recesses and a middle peripheral bulge for forming a wavy structure.

8 Claims, 4 Drawing Sheets

PUNCHING AID

The present invention relates to the co-pending U.S. patent application Ser. No. 09/432,065, filed on Oct. 27, 1999, and the co-pending U.S. patent application Ser. No. 09/479,178, filed on Jan. 5, 2000.

BACKGROUND OF THE INVENTION

1. Field of the Invention

The present invention relates to a punching aid, and more particularly to a punching aid for home use.

2. Description of the Prior Art

Various kinds of punching aids or striking devices have been developed. U.S. Pat. No. 2,085,161 to Kraus, U.S. Pat. No. 2,913,245 to Landis, U.S. Pat. No. 4,486,016 to Rubin, U.S. Pat. No. 4,662,630 to Dignard et al., U.S. Pat. No. 5,330,403 to Kuo U.S. Pat. No. 5,415,552 to Harmon et al., U.S. Pat. No. 5,921,895 to Lynch et al., all disclose a typical punching aid or striking device having a bag coupled to a support with one or more flexible or helical spring or metal members. The spring or metal support members may not be easily bent during punching operations.

U.S. Pat. No. 5,624,358 to Hestilow discloses a further punching device including a column extended upward from a pedestal and formed integral as an integral one piece unit. The column is solidly secured to or extended from the pedestal and is made of plastic material that are not flexible, such that the column may not be easily bent while punching. In addition, the punching device occupies a great volume which is adverse for transportation and carrying purposes.

None of the prior striking devices or punching aids suggest to provide a flexible rubber pillar coupled between the base and the pad.

The present invention has arisen to mitigate and/or obviate the afore-described disadvantages of the conventional punching or boxing aids.

SUMMARY OF THE INVENTION

The primary objective of the present invention is to provide a punching aid including a flexible rubber pillar for facilitating the punching or boxing exercises and including a detachable structure for allowing the punching aid to be disassembled and packaged to a compact configuration.

In accordance with one aspect of the invention, there is provided a punching aid comprising a base, a column provided above the base, a pad attached onto the column, a flexible rubber pillar, and means for securing the flexible rubber pillar between the base and the column to provide a flexibility to the column relative to the base. The pillar is made of rubber material for providing an excellent resilience to the column and the pad relative to the base.

The flexible rubber pillar includes a first end, the securing means includes a first coupler provided on the first end of the flexible rubber pillar, a second coupler provided on the base, and means for locking the second coupler and the first coupler together.

The first coupler includes a protrusion engaged into the first end of the flexible rubber pillar, and includes a disc secured on the protrusion and engaged in the first end of the flexible rubber pillar.

The flexible rubber pillar includes an upper peripheral recess and a lower peripheral recess formed therein and includes a middle portion having a peripheral bulge formed thereon. The peripheral recesses of the flexible rubber pillar are curved. The peripheral bulge of the flexible rubber pillar is convex.

The flexible rubber pillar includes at least one peripheral rib formed between the peripheral bulge and the upper peripheral recess of the flexible rubber pillar, and includes at least one peripheral rib formed between the peripheral bulge and the lower peripheral recess of the flexible rubber pillar and includes at least one longitudinal rib formed thereon for increasing a strength of the flexible rubber pillar.

A shielding or covering sleeve device is further provided and attached onto the flexible rubber pillar for shielding the flexible rubber pillar and for preventing the users and the children from being hurt by the flexible rubber pillar.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
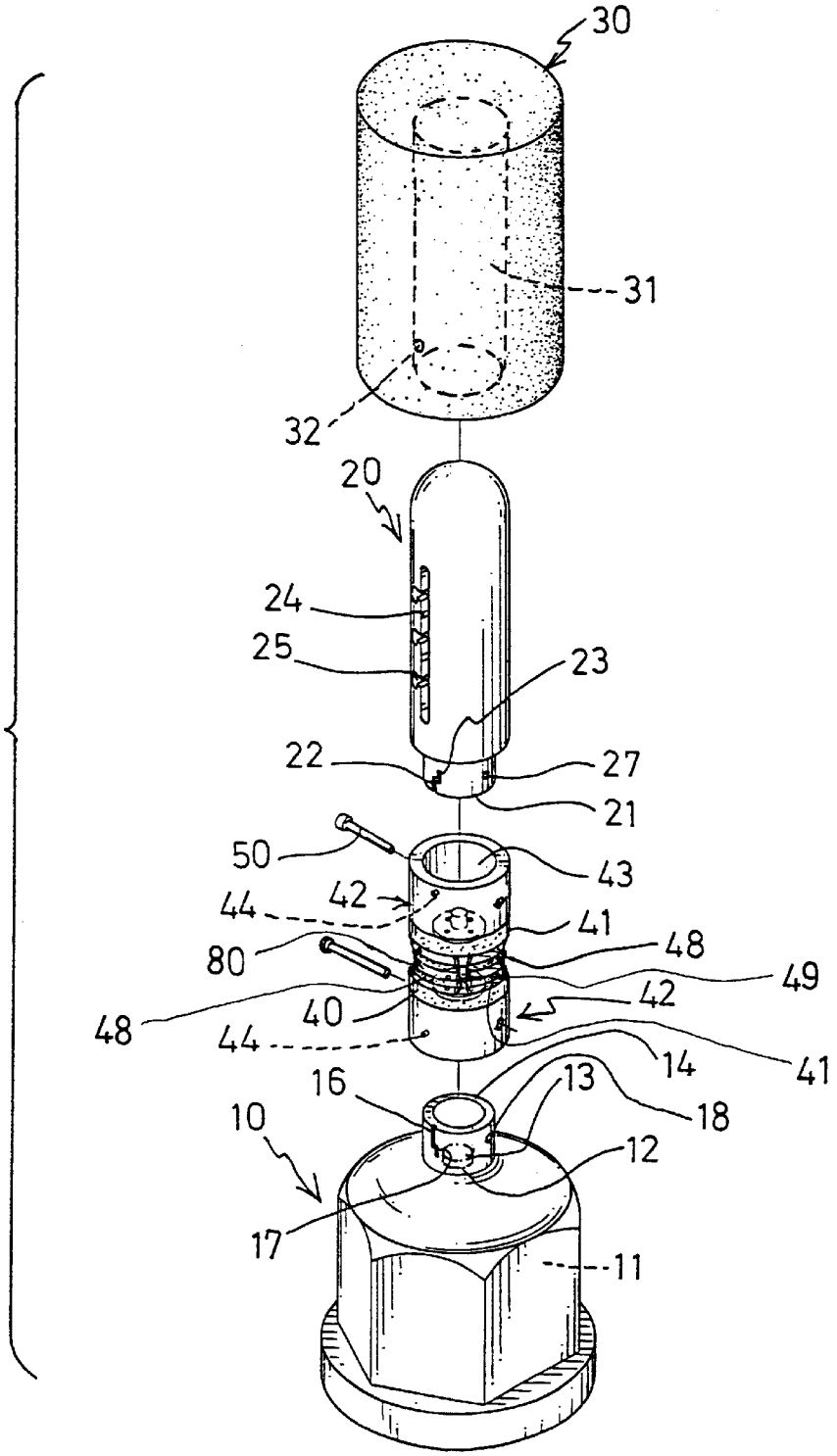
FIG. 1 is an exploded view of a punching aid in accordance with the present invention.
Figure 2:
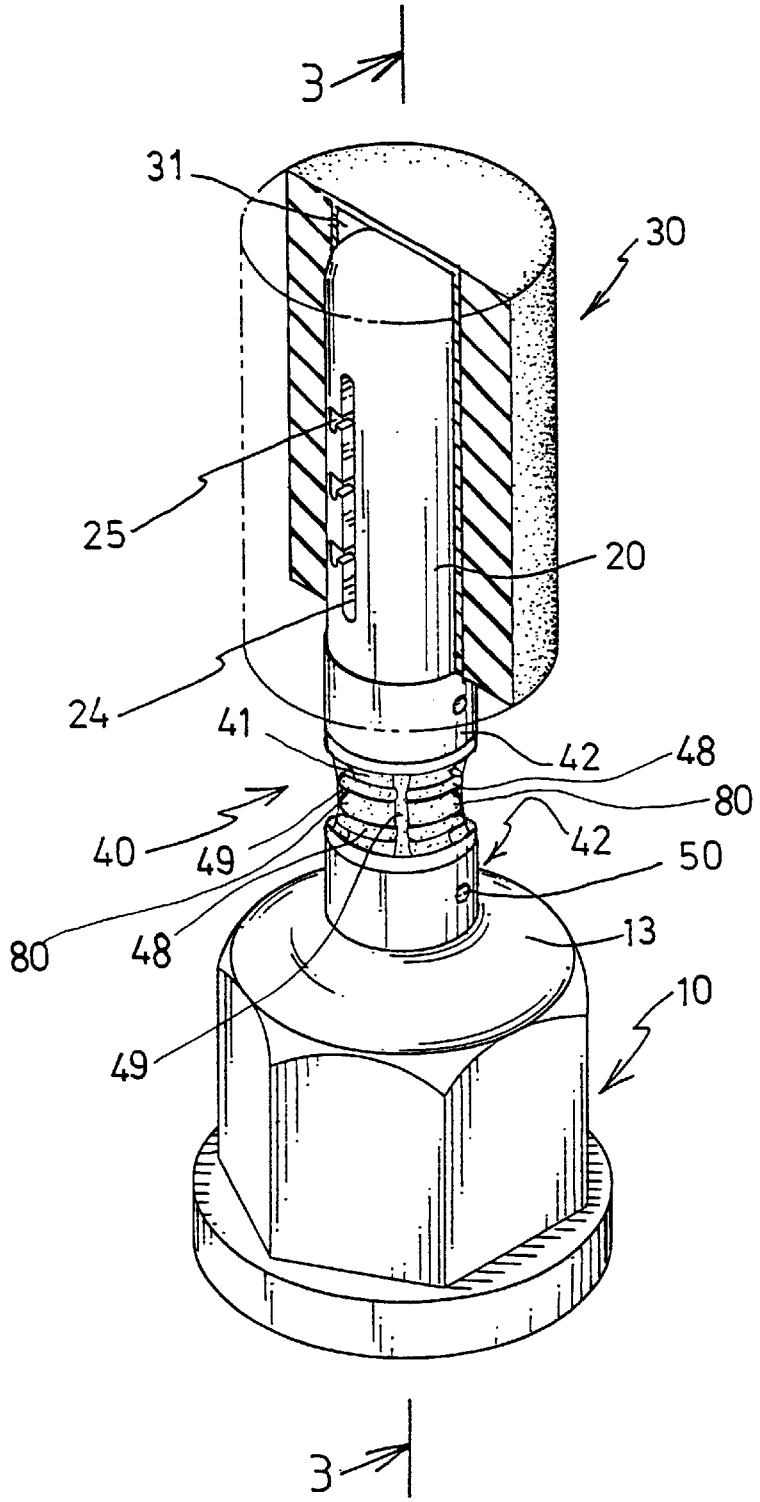
FIG. 2 is a perspective view of the punching aid, in which a portion of the cover is cut off.
Figure 3:
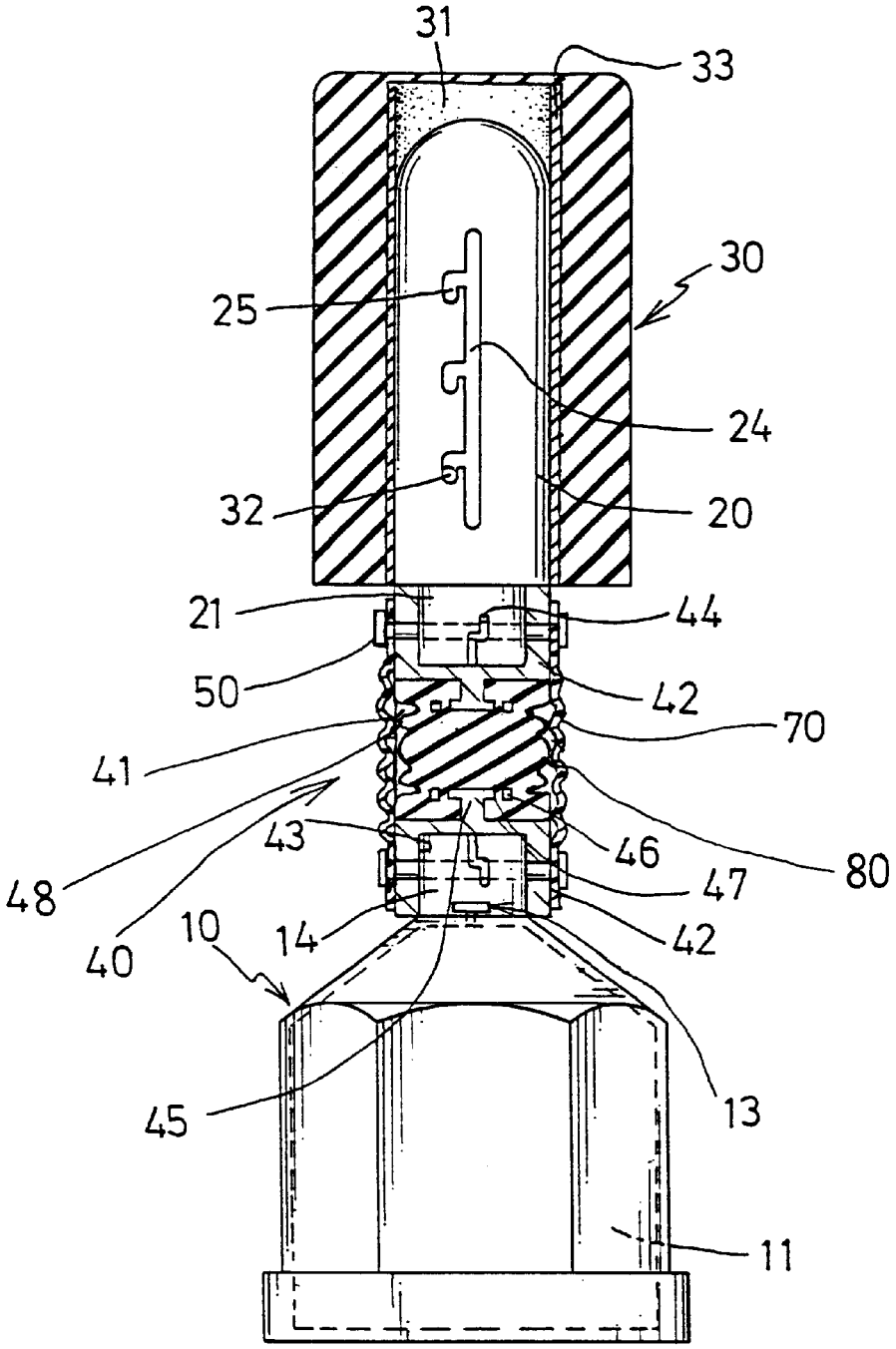
FIG. 3 is a cross sectional view taken along lines 3—3 of FIG. 2.

Referring to the drawings, and initially to FIGS. 1–3, a punching aid in accordance with the present invention comprises a base 10 including a chamber 11 formed therein for receiving fluids and including a mouth 12 formed in the upper middle portion thereof (FIGS. 1, 3, 5) and communicating with the chamber 11 of the base 10 for receiving the fluids, such as the water, any suitable liquid, or other particulate materials, such as sand, gravel, coated or uncoated metallic shot and the like, to give the punching aid stability. A cap 13 is detachably secured onto the mouth 12 of the base 10 for enclosing the chamber 11 of the base 10 and for confining the fluids within the base 10. The mouth and the cap 13 may also be formed in the upper side portion of the base 10 for filing the weight materials into the chamber 11 of the base 10. The base 10 includes a coupler, such as a stud 14 extended upward therefrom and having one or more, preferably two, grooves 16 formed therein. The grooves 16 have an open upper end and are preferably vertical and have a lock slot 17 formed in the lower portion thereof. The stud 14 includes an aperture 18 formed therein for threading a fastener or a pin 50. The base 10 may also be made to a solid structure, with such as the plastic materials, having a suitable stability.

Figure 4:
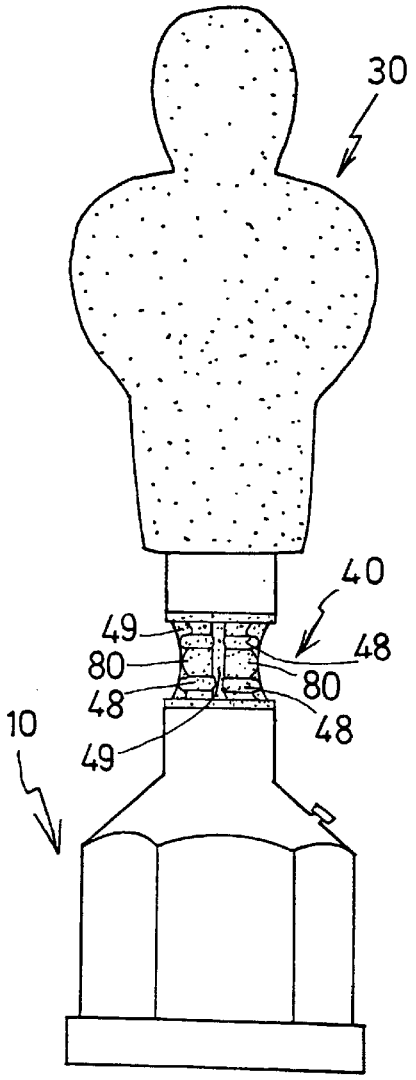
FIG. 4 is a plane view of the punching aid.

A column 20 is to be secured vertically on top of the base 10 and includes a coupler, such as a stud 21 provided on the lower portion thereof. The stud 21 is similar to the stud 14 of the base 10 and includes one or more, preferably two, grooves 22 formed therein. The grooves 22 have an open lower end and is preferably vertical and have a lock slot 23 formed in the upper portion thereof. The stud 21 includes an aperture 27 formed therein for threading a fastener or a pin 50. The column 20 includes one or more longitudinal channels 24 formed therein and having one or more lock slots 25 communicating with the respective channels 24. A striking pad 30 includes a bore 31 formed therein for receiving the column 20 and includes one or more projections 32 extended inward of the bore 31 thereof for engaging into the channels 24 and/or the lock slots 25 of the column 20 and for setting the pad 30 to various heights. The pad 30 is preferably made of spongy or rubber materials for striking purposes, and may be formed into various kinds of shapes, such as a human body shape (FIG. 4) or a cylindrical shape (FIGS. 1–3). The pad 30 preferably may include an enclosed (FIGS. 1–3) or open (FIGS. 5–7) upper portion. As best shown in FIGS. 2 and 3, a barrel 33 is preferably engaged in and secured in the inner portion of the pad 30 for defining the bore 31 of the pad 30 and is made of harder or stronger materials than that for the pad 30, such as plastic materials, and has the projections 32 extended therefrom. The projections 32 are also made of the stronger materials and thus have a suitable strength for engaging into the channels 24 and the lock slots 25 of the column 20 and for supporting the pad 30 on the column 20 at the required height.

A flexible pillar 40 includes two couplers 42 secured to the ends thereof, such as the upper and the lower ends thereof for securing or fastening or locking onto the studs 14, 21 of the base 10 and the column 20 and for providing a flexibility to the column 20 relative to the base 10. The couplers 42 each includes a hole 43 formed therein for receiving the respective stud 14, 21 and each includes a projection 44 extended inward of the hole 43 thereof for engaging into the grooves 16, 22 and the lock slots 17, 23 of the studs 14, 21 and for securing the flexible pillar 40 between the base 10 and the column 20. The pins 50 may be engaged through the couplers 42 and the studs 14, 21 for further solidly securing the flexible pillar 40 between the base 10 and the column 20. The flexible pillar 40 is preferably made of rubber or synthetic rubber materials etc., and may be made to a size or a diameter no less than that of the column 20. However, if the material is strong enough, the flexible pillar 40 may be made to a smaller size than that of the column 20.

As best shown in FIG. 3, the couplers 42 each includes a protrusion 45 extended inward of the flexible pillar 40 and a disc 46 formed or provided on the end portion of the protrusion 45. The protrusion 45 and the disc 46 of each coupler 42 may be engaged in the flexible pillar 40 when molding the flexible pillar 40 onto the couplers 42 such that the flexible pillar 40 may be solidly secured to the couplers 42. The discs 46 may each further include one or more openings 47 formed therein. The material for forming the flexible pillar 40 may be engaged into the openings 47 of the discs 46 while molding the flexible pillar 40 onto the couplers 42 such that the flexible pillar 40 may further be solidly secured to the couplers 42.

The above described structure has been described in the co-pending U.S. pat. application Ser. No. 09/432,065, filed on Oct. 27, 1999, and the co-pending U.S. patent application Ser. No. 09/479,178, filed on Jan. 5, 2000, which are taken as the references for the present invention.

The most important characteristic for the punching aid is that the flexible pillar 40 is made of rubber or synthetic materials and has the upper and the lower portions coupled to the column 20 and the base 10 respectively. None of the arts may provide a flexible rubber pillar 40 directly coupled to the base 10 and the column 20. Although the flexible pillar 40 is shown to be coupled to the base 10 and the column 20 with the engagement between the stud and the coupler, the flexible rubber pillar 40 may also be directly coupled to the base and the column with fasteners without the studs and the couplers. The typical spring members may not be easily coupled between the base and the column. The column 20 and the pad 30 and/or the flexible pillar 40 may be detached or disengaged from the base 10 such that the column of the punching aid may be greatly decreased for facilitating the storing and the transportation thereof.

For increasing the flexibility of the pillar 40, the flexible rubber pillar 40 includes an upper portion having a peripheral curved recess 41 formed therein, and includes a lower portion having a peripheral curved or concave recess 41 formed therein, and includes a middle portion having a convex or an outwardly curved peripheral bulge 80 formed thereon, for forming a wavy shape and for increasing the flexibility of the pillar 40. The pillar 40 further includes one or more peripheral ribs 48 formed thereon, preferably formed between the peripheral recesses 41 and the peripheral bulge 80, and includes one or more longitudinal ribs 49 formed thereon and intersecting with the ribs 48 in order to form a spider-rib structure and in order to increase the strength of the flexible pillar 40.

Figure 5:
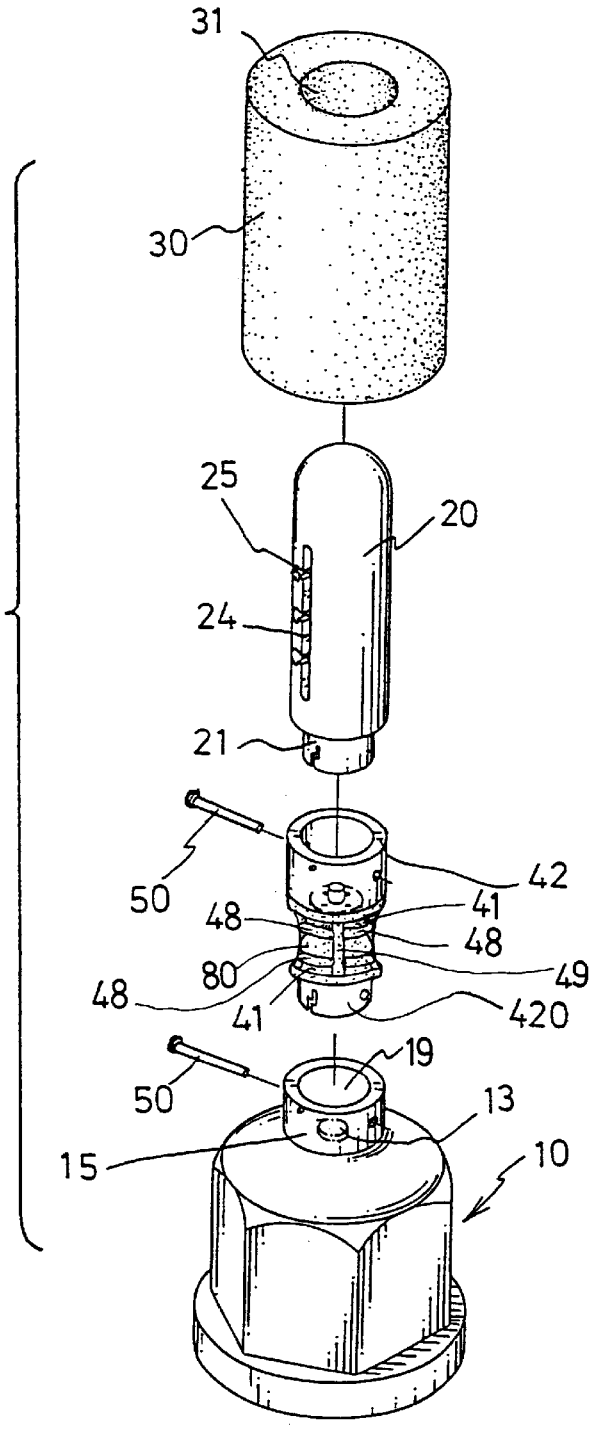
FIG. 5 is an exploded view illustrating the another application of the punching aid.

As shown in FIG. 5, one of the couplers 420 secured to the flexible pillar 40 may be a stud-shaped coupler 420 similar to that (14, 21) of the base 10 and the column 20. The column 20 or the base 10 may include a socket 100 similar to the couplers 42 as shown in FIGS. 1–3 and having a hole 19 formed therein for receiving the stud-shaped coupler 420 which may also be secured to the socket 100 with a projection-lock slot engagement and/or a locking pin. The socket or the stud 21 of the column 20 may be directly secured to the stud or the socket 15 of the base 10 without the flexible pillar 40 for decreasing the height of the punching aid and for being easily stricken by the children.

As best shown in FIG. 3, a flexible or protective sleeve 70, such as a bellows type sleeve, is further provided and engaged onto the flexible pillar 40 for shielding and protecting the flexible pillar 40, particularly for shielding the peripheral ribs 48 and the longitudinal ribs 49 of the flexible pillar 40. The protective sleeve 70 may include the upper and the lower portions secured to the couplers 42 with the fastener pins 50, for example.

Accordingly, the punching aid in accordance with the present invention includes a flexible rubber pillar for facilitating the punching or boxing exercises, and includes a detachable structure for allowing the punching aid to be disassembled and packaged to a compact configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A punching aid comprising:

a base, a column provided above said base, a pad attached onto said column, a flexible rubber pillar including a first end, and means for securing said flexible rubber pillar between said base and said column to provide a flexibility to said column relative to said base, said securing means including a first coupler provided on said first end of said flexible rubber pillar, a second coupler provided on said base, and means for locking said second coupler and said first coupler together.

2. The punching aid according to claim 1, wherein said first coupler includes a protrusion engaged into said first end of said flexible rubber pillar, and includes a disc secured on said protrusion and engaged in said first end of said flexible rubber pillar.

3. A punching aid comprising:

a base, a column provided above said base, a pad attached onto said column, a flexible rubber pillar including an upper peripheral recess and a lower peripheral recess formed therein and including a middle portion having a peripheral bulge formed thereon, and means for securing said flexible rubber pillar between said base and said column to provide a flexibility to said column relative to said base.

4. The punching aid according to claim 3, wherein said peripheral recesses of said flexible rubber pillar are curved.

5. The punching aid according to claim 3, wherein said peripheral bulge of said flexible rubber pillar is convex.

6. The punching aid according to claim 3, wherein said flexible rubber pillar includes at least one peripheral rib formed between said peripheral bulge and said upper peripheral recess of said flexible rubber pillar, and includes at least one peripheral rib formed between said peripheral bulge and said lower peripheral recess of said flexible rubber pillar.

7. The punching aid according to claim 3, wherein said flexible rubber pillar includes at least one longitudinal rib formed thereon for increasing a strength of said flexible rubber pillar.

8. A punching aid comprising:

a base, a column provided above said base, a pad attached onto said column, a flexible rubber pillar, means for securing said flexible rubber pillar between said base and said column to provide a flexibility to said column relative to said base, and means for shielding said flexible rubber pillar.

* * * * *